US007438241B2

(12) United States Patent
Goenka et al.

(10) Patent No.: US 7,438,241 B2
(45) Date of Patent: Oct. 21, 2008

(54) LOW PRESSURE FUEL INJECTOR NOZZLE

(75) Inventors: Lakhi N. Goenka, Ann Arbor, MI (US); Jeffrey Paul Mara, Livonia, MI (US); David Lee Porter, Westland, MI (US); David Ling-Shun Hung, Novi, MI (US); John Stefanski, Pinckney, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 140 days.

(21) Appl. No.: 10/981,870

(22) Filed: Nov. 5, 2004

(65) Prior Publication Data

US 2006/0097087 A1 May 11, 2006

(51) Int. Cl.
*F02M 61/00* (2006.01)

(52) U.S. Cl. ..... 239/533.12; 239/500; 239/518; 239/601; 239/596

(58) Field of Classification Search ..... 239/533.12, 239/585.1–585.5, 900, 466, 494, 497, 500, 239/504, 518, 596, 601, 554, 555, 558, 557, 239/563, 564
See application file for complete search history.

(56) References Cited

U.S. PATENT DOCUMENTS

| | | | | |
|---|---|---|---|---|
| 3,326,191 | A | | 6/1967 | Berlyn |
| 4,018,387 | A | | 4/1977 | Erb et al. |
| 4,106,702 | A | | 8/1978 | Gardner et al. |
| 4,139,158 | A | | 2/1979 | Uehida |
| 4,254,915 | A | | 3/1981 | Muller |
| 4,275,845 | A | | 6/1981 | Muller |
| 4,346,848 | A | | 8/1982 | Malcolm |
| 4,540,126 | A | | 9/1985 | Yoneda et al. |
| 4,650,122 | A | | 3/1987 | Kienzle et al. |
| 4,666,088 | A | | 5/1987 | Krauss et al. |
| 4,801,095 | A | | 1/1989 | Banzhaf et al. |
| 4,907,748 | A | | 3/1990 | Gardner et al. |
| 4,934,653 | A | * | 6/1990 | Grieb et al. ..... 251/118 |
| 5,163,621 | A | | 11/1992 | Kato et al. |
| 5,201,806 | A | | 4/1993 | Wood |
| 5,244,154 | A | | 9/1993 | Buchholz et al. |
| 5,344,081 | A | | 9/1994 | Wakeman |
| 5,383,597 | A | | 1/1995 | Sooriakumar et al. |
| 5,402,943 | A | | 4/1995 | King et al. |
| 5,449,114 | A | | 9/1995 | Wells et al. |
| 5,497,947 | A | | 3/1996 | Potz et al. |
| 5,533,482 | A | | 7/1996 | Naitoh |
| 5,553,790 | A | | 9/1996 | Findler et al. |
| 5,570,841 | A | | 11/1996 | Pace et al. |
| 5,636,796 | A | | 6/1997 | Oguma |
| 5,662,277 | A | | 9/1997 | Taubitz et al. |
| 5,685,485 | A | | 11/1997 | Mock et al. |

(Continued)

FOREIGN PATENT DOCUMENTS

| | | | |
|---|---|---|---|
| EP | 0 551 633 | A1 | 7/1993 |

(Continued)

*Primary Examiner*—Christopher S Kim
(74) *Attorney, Agent, or Firm*—Brinks Hofer Gilson & Lione

(57) ABSTRACT

A nozzle for a low pressure fuel injector that improves the control and size of the spray angle, as well as enhances the atomization of the fuel delivered to a cylinder of an engine.

20 Claims, 3 Drawing Sheets

U.S. PATENT DOCUMENTS 5,685,491 A 11/1997 Marks et al.
5,716,001 A 2/1998 Wakeman et al.
5,716,009 A 2/1998 Ogihara et al.
5,762,272 A 6/1998 Tani et al.
5,899,390 A * 5/1999 Arndt et al. ..... 239/553
5,911,366 A 6/1999 Maier et al.
5,915,352 A 6/1999 Okamoto et al.
5,924,634 A 7/1999 Arndt et al.
5,934,571 A 8/1999 Schmidt et al.
6,029,913 A 2/2000 Stroia et al.
6,045,063 A 4/2000 Koike et al.
6,050,507 A 4/2000 Holzgrefe et al.
6,092,743 A 7/2000 Shibata et al.
6,102,299 A 8/2000 Pace et al.
6,168,094 B1 1/2001 Schatz et al.
6,168,095 B1 1/2001 Seitter et al.
6,176,441 B1 1/2001 Munezane et al.
6,257,496 B1 7/2001 Wyant
6,273,349 B1 8/2001 Fischbach et al.
6,296,199 B1 10/2001 Noller et al.
6,308,901 B1 10/2001 Nitkiewicz et al.
6,330,981 B1 12/2001 Nally, Jr. et al.
6,394,367 B2 5/2002 Munezane et al.
6,405,945 B1 6/2002 Dobrin
6,439,482 B2 8/2002 Hosoyama et al.
6,439,484 B2 8/2002 Harata et al.
6,494,388 B1 12/2002 Mueller et al.
6,499,674 B2 12/2002 Ren et al.
6,502,769 B2 1/2003 Imoehl
6,513,724 B1 2/2003 Joseph et al.
6,520,145 B2 2/2003 Hunkert
6,533,197 B1 3/2003 Takeuchi et al.
6,547,163 B1 4/2003 Mansour et al.
6,578,778 B2 6/2003 Koizumi et al.
6,581,574 B1 6/2003 Moran et al.
6,616,072 B2 9/2003 Harata et al.
6,626,381 B2 9/2003 Parrish
6,644,565 B2 11/2003 Hockenberger
6,666,388 B2 12/2003 Ricco
6,669,103 B2 12/2003 Tsai
6,669,116 B2 12/2003 Iwase
6,685,112 B1 2/2004 Hornby et al.
6,695,229 B1 2/2004 Heinbuch et al.
6,705,274 B2 3/2004 Kubo
6,708,904 B2 3/2004 Itatsu
6,708,905 B2 3/2004 Borissov et al.
6,708,907 B2 3/2004 Fochtman et al.
6,712,037 B2 3/2004 Xu
6,719,223 B2 4/2004 Yukinawa et al.
6,722,340 B1 4/2004 Sukegawa et al.
6,739,525 B2 5/2004 Dantes et al.
6,742,727 B1 6/2004 Peterson, Jr.
6,758,420 B2 7/2004 Arioka et al.
6,764,033 B2 7/2004 Dantes et al.
6,766,969 B2 7/2004 Haltiner, Jr. et al.
6,783,085 B2 8/2004 Xu
6,817,545 B2 11/2004 Xu
6,848,636 B2 2/2005 Munezane et al.
6,921,022 B2 7/2005 Nally et al.
6,929,196 B2 8/2005 Togashi et al.
6,966,499 B2 11/2005 Nally et al.
2001/0017325 A1 8/2001 Harata et al.
2002/0008166 A1 1/2002 Fukaya et al.
2002/0092929 A1 7/2002 Arimoto
2002/0144671 A1 10/2002 Shiraishi et al.
2002/0170987 A1 11/2002 Aoki et al.
2003/0127540 A1 7/2003 Xu
2003/0127547 A1 7/2003 Nowak
2003/0141385 A1 7/2003 Xu
2003/0141387 A1 7/2003 Xu
2003/0173430 A1 9/2003 Spencer
2003/0234005 A1 12/2003 Sumisha et al.
2004/0050976 A1 3/2004 Kitamura
2004/0060538 A1 4/2004 Togashi et al.
2004/0104285 A1 6/2004 Okamoto et al.
2004/0129806 A1 7/2004 Dantes et al.

FOREIGN PATENT DOCUMENTS

EP 0 611 886 B1 12/1998
GB 0 232 203 A 12/1990
JP 2-19654 1/1990
JP 5-280442 1/1993
JP 6-221163 8/1994
JP 2001-046919 2/2001
WO WO 93/04277 3/1993
WO WO 93/20349 10/1993
WO WO 95/04881 2/1995

* cited by examiner

LOW PRESSURE FUEL INJECTOR NOZZLE

FIELD OF THE INVENTION

The present invention relates generally to fuel injectors for automotive engines, and more particularly relates to fuel injector nozzles capable of atomizing fuel at relatively low pressures.

BACKGROUND OF THE INVENTION

Stringent emission standards for internal combustion engines suggest the use of advanced fuel metering techniques that provide extremely small fuel droplets. The fine atomization of the fuel not only improves emission quality of the exhaust, but also improves the cold weather start capabilities, fuel consumption and performance. Typically, optimization of the droplet sizes dependent upon the pressure of the fuel, and requires high pressure delivery at roughly 7 to 10 MPa. However, a higher fuel delivery pressure causes greater dissipation of the fuel within the cylinder, and propagates the fuel further outward away from the injector nozzle. This propagation makes it more likely that the fuel spray will condense on the walls of the cylinder and the top surface of the piston, which decreases the efficiency of the combustion and increases emissions.

To address these problems, a fuel injection system has been proposed which utilizes low pressure fuel, define herein as generally less than 4 MPa, while at the same time providing sufficient atomization of the fuel. One exemplary system is found in U.S. Pat. No. 6,712,037, commonly owned by the Assignee of the present invention, the disclosure of which is hereby incorporated by reference in its entirety. Generally, such low pressure fuel injectors employ sharp edges at the nozzle orifice for atomization and acceleration of the fuel. However, the relatively low pressure of the fuel and the sharp edges result in the spray being difficult to direct and reduces the range of the spray. More particularly, the spray angle or cone angle produced by the nozzle is somewhat more narrow. At the same time, additional improvement to the atomization of the low pressure fuel would only serve to increase the efficiency and operation of the engine and fuel injector.

Accordingly, there exists a need to provide a fuel injector having a nozzle design capable of sufficiently injecting low pressure fuel while increasing the control and size of the spray angle, as well as enhancing the atomization of the fuel.

BRIEF SUMMARY OF THE INVENTION

One embodiment of the present invention provides a nozzle for a low pressure fuel injector which increases the spray angle and enhances atomization of the fuel delivered to a cylinder of an engine. The nozzle generally comprises a nozzle body and a metering plate. The nozzle body defines a valve outlet and a longitudinal axis. The metering plate is connected to the nozzle body and is in fluid communication with the valve outlet. The metering plate defines a nozzle cavity which receives fuel from the valve outlet. The metering plate defines a plurality of exit cavities receiving fuel from the nozzle cavity. Each exit cavity is radially spaced from the longitudinal axis and is oriented along a radial axis. Each exit cavity has an upstream portion and a downstream portion. The upstream portion is defined by a series of steps narrowing towards the downstream portion.

According to more detailed aspects, the series of steps define a series of recirculation zones. In these zones, the fluid flows in a trapped circular pattern. Thus, the recirculation zones disrupt the fluid flowing in the immediate area thereof. Generally, the recirculation zones are located on the upper surface of each step. Preferably, the series of steps form a conical shape, wherein each step is annular. Accordingly, each step may be either circular, square or rectangular in shape. The downstream portion of the exit cavity preferably is conical in shape and flares outwardly. The transition between the upstream portion and downstream portion of each exit cavity preferably defines a sharp edged downstream exit orifice.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
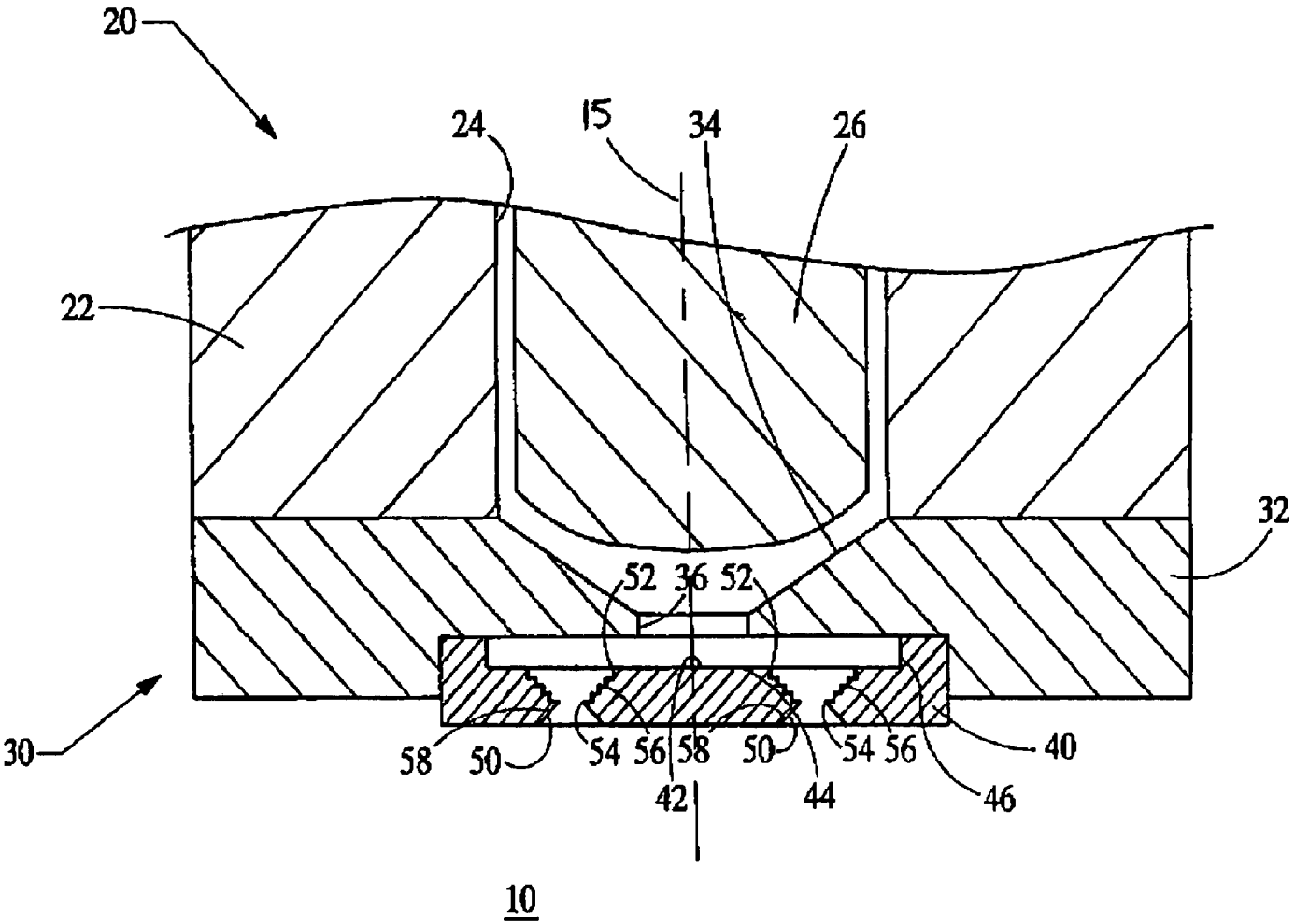
FIG. 1 is a cross-sectional view, partially cut-away, of a nozzle for a low pressure fuel injector constructed in accordance with the teachings of the present invention.

Turning now to the figures, FIG. 1 depicts a cross-sectional of a nozzle 20 constructed in accordance with the teachings of the present invention. The nozzle 20 is formed at a lower end of a low pressure fuel injector which is used to deliver fuel to a cylinder 10 of an engine, such as an internal combustion engine of an automobile. An injector body 22 defines an internal passageway 24 having a needle 26 positioned therein. The injector body 22 defines a longitudinal axis 15, and the internal passageway 24 extends generally parallel to the longitudinal axis 15. A lower end of the injector body 22 defines a nozzle body 32. It will be recognized by those skilled in the art that the injector body 22 and nozzle body 32 may be integrally formed, or alternatively the nozzle body 32 may be separately formed and attached to the distal end of the injector body 22 by welding or other well known techniques.

In either case, the nozzle body 32 defines a valve seat 34 leading to a valve outlet 36. The needle 26 is translated longitudinally in and out of engagement with the valve seat 34 preferably by an electromagnetic actuator or the like. In this manner, fuel flowing through the internal passageway 24 and around the needle 26 is either permitted or prevented from flowing to the valve outlet 36 by the engagement or disengagement of the needle 26 and valve seat 34.

The nozzle 20 further includes a metering plate 40 which is attached to the nozzle body 32. It will be recognized by those skilled in the art that the metering plate 40 may be integrally formed with the nozzle body 32, or alternatively may be separately formed and attached to the nozzle body 32 by welding or other well known techniques. In either case, the metering plate 40 defines a nozzle cavity 42 receiving fuel from the valve outlet 36. The nozzle cavity 42 is generally defined by a bottom wall 44 and a side wall 46 which are formed into the metering plate 40. The metering plate 40 further defines a plurality of exit cavities 50 receiving fuel from the nozzle cavity 42. Each exit cavity 50 is radially spaced from the longitudinal axis 15 and meets the nozzle cavity 42 at an exit orifice 52.

It can also be seen in FIG. 1 that the metering plate 40 has been uniquely structured to improve the spray angle and increase the atomization of fuel flowing through the metering plate 40. In particular, each exit cavity 50 has been divided into an upstream portion 56 and a downstream portion 58. Accordingly, each exit cavity 50 defines an upstream exit orifice 52 and a downstream exit orifice 54. The upstream exit orifice 52 is located along the plane where the nozzle cavity 42 meets the exit cavity 50. The downstream exit orifice 54 is located along the line where the upstream and downstream portions 56, 58 meet within the exit cavity 50. The upstream and downstream exit orifices 52, 54 are sharp edged to further enhance the turbulence.

Figure 2:
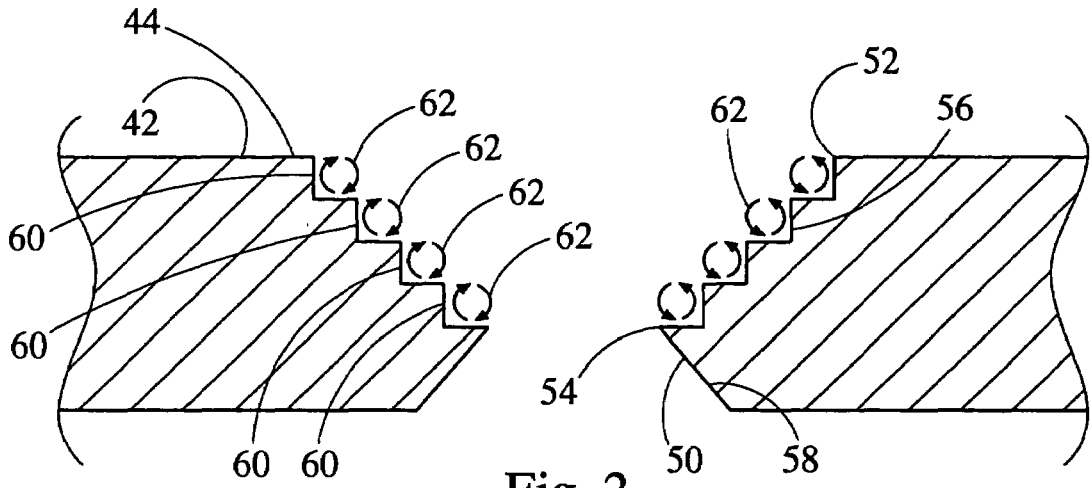
FIG. 2 is an enlarged cross-sectional view, partially cut-away, of a metering plate forming a portion of the nozzle depicted in FIG. 1.

As best seen in the enlarged view of FIG. 2, the upstream portion 56 of each exit cavity 50 is defined by a series of steps 60. The series of steps 60 narrow as the upstream portion 56 transitions towards the downstream portion 58. The series of steps 60 define a series of recirculation zones 62 located at an upper surface of each step 60. Each recirculation zone 62 represents an area where fluid flows in a generally trapped circular pattern, as indicated by the arrows. In this manner, the recirculation zones 62 disturb the fuel flowing thereby, increasing the turbulence in the fuel. This in turn increases the atomization of the fuel as it accelerates through the exit orifice 50. It will also be seen that the provision of two sharp edged orifices, namely the upstream exit orifice 52 and the downstream exit orifice 54, also promotes atomization of the fuel.

As shown in FIG. 2, the exit cavity 50 defines an exit axis 55. The exit axis 55 is generally parallel to the longitudinal axis 15 of the injector nozzle bodies 22, 32. However, it will be recognized that the axis for each exit cavity 50 may be angled relative to the longitudinal axis 15 in order to enhance the cone angle or spray angle of the nozzle 20. Likewise, it will be recognized that the downstream portion 58 of the exit cavity 50 may be oriented along an axis which differs from the axis of the upstream portion 56 of the exit cavity 50. Still further, the downstream portion 58 has been shown as flared and generally conical. However, it will be recognized that the shape, and/or the axis of orientation, of the downstream portion 58 may be oriented to produce the desired spray angle for the nozzle 20.

Figure 3:
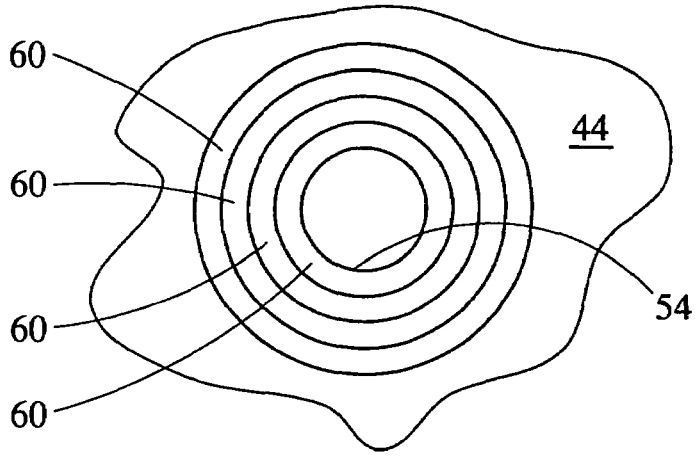
FIG. 3 is a plan view, partially cut-away, of the metering plate depicted in FIG. 2.
Figure 4:
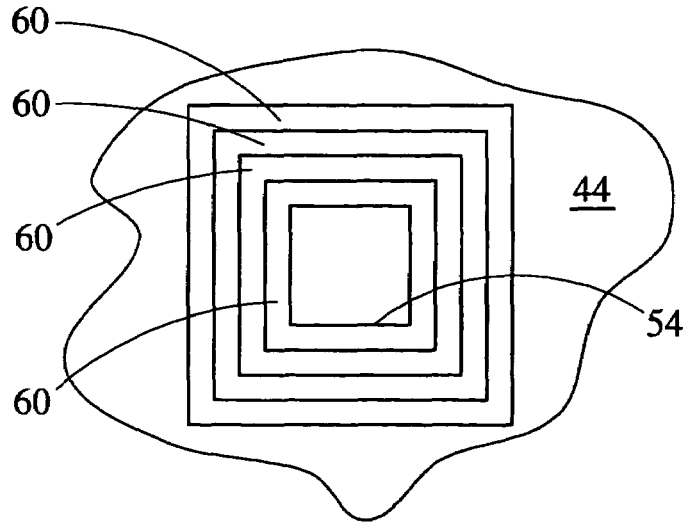
FIG. 4 is a plan view, partially cut-away, of an alternate embodiment of the metering plate depicted in FIGS. 1 to 3.

Turning now to FIG. 3, a plan view of the metering plate 40 depicted in FIG. 2 has been shown. It can be seen that the series of steps 60 forming the upstream portion 56 of the exit cavity 50 are annular in shape, and most preferably are circular in shape. However, the upstream portion 56 can take virtually any shape which defines a series of narrowing steps, and can include shapes such as square as depicted in FIG. 4. In this alternate embodiment of the metering plate 40*a*, the upstream portion 56*a* of the exit cavity 50 includes a series of square shape steps 60*a* which narrow down towards the downstream exit orifice 54*a* which is also square in shape.

Figure 5:
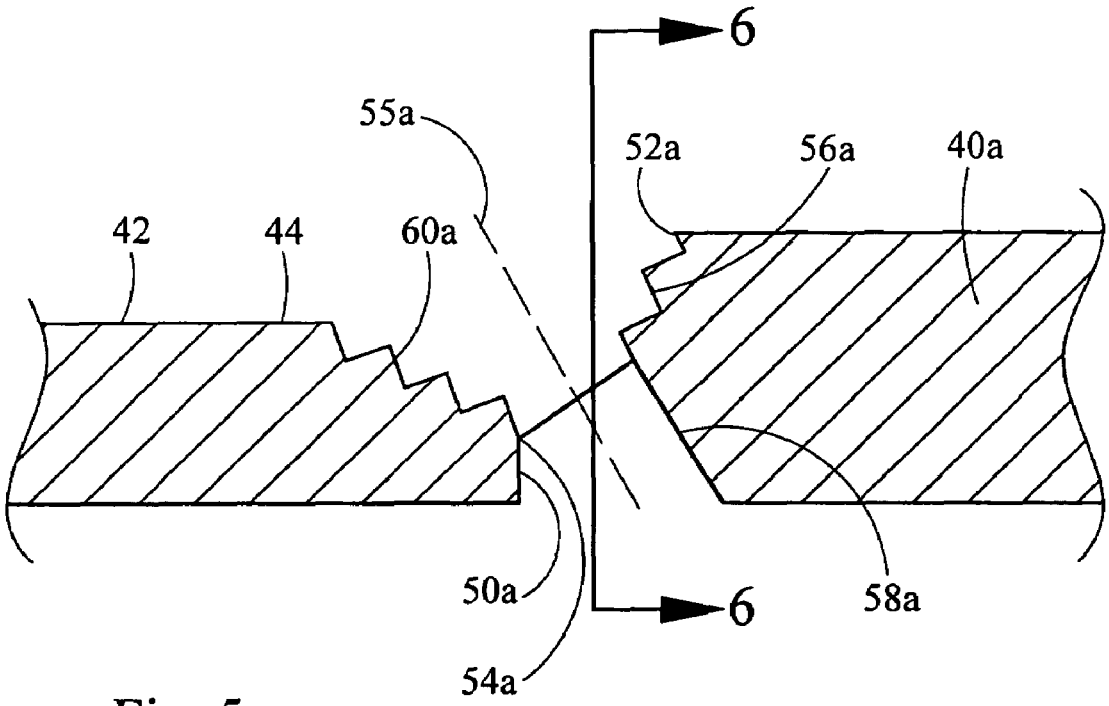
FIG. 5 is an enlarged cross-sectional view, partially cut-away, of another embodiment of the metering plate depicted in FIG. 2.
Figure 6:
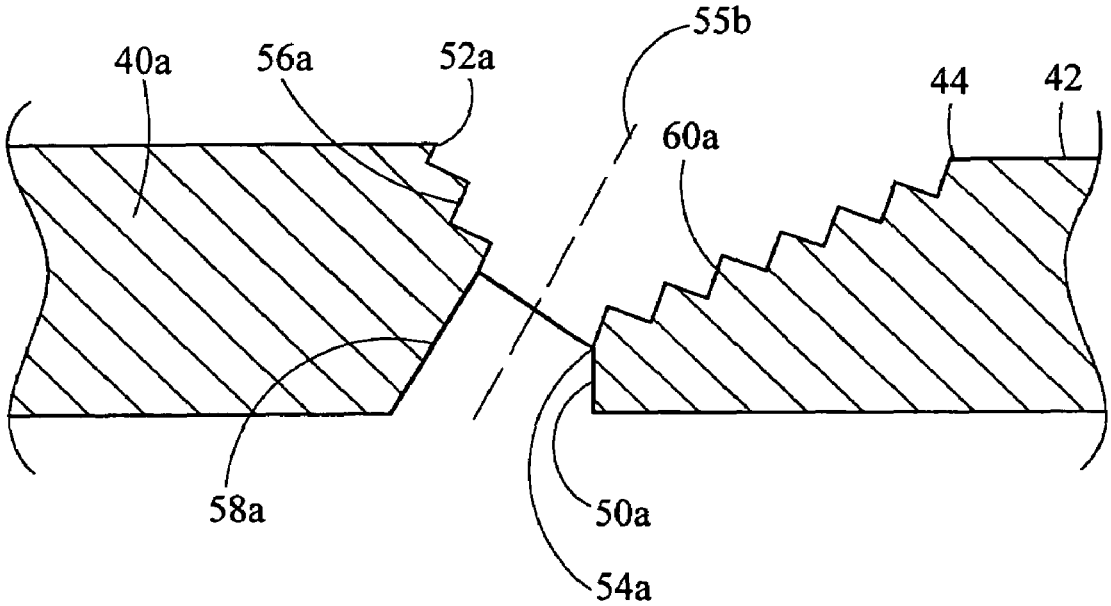
FIG. 6 is an enlarged cross-sectional view, partially cut-away, taken about line 6-6 in FIG. 5.

With reference to FIGS. 5 and 6, an alternate embodiment of the metering plate 40*a* has been depicted. As in the prior embodiment, the exit cavity 50*a* generally includes an upstream portion 56*a* and a downstream portion 58*a*. The upstream portion 56*a* again includes a series of steps 60*a* which define recirculation zones for adding turbulence to the fuel flowing through the exit cavity 50*a*, thereby promoting atomization of the fuel. In this embodiment, however, the exit cavity 50*a* has been oriented along an exit axis 55*a* which is tilted radially relative to the longitudinal axis 15, and more particularly is angled radially outwardly. In this manner, the spray angle of the fuel flowing though the nozzle 20 may be increased. At the same time, the exit axis 55*a* is also preferably tilted in the tangential direction relative to the longitudinal axis 15, as shown in FIG. 6. Accordingly, the orientation of the exit cavity 50 along its exit axis 55 results in a swirl component being provided to the fuel exiting the metering plate 40 in the nozzle 20. The swirl component further enhances the atomization of the fuel, or at the same time increasing the spray angle of the nozzle 20. Further, the structure and orientation of each exit cavity, in concert with the plurality of exit cavities, enhances the spray angle and control over the direction of the spray.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate defining a nozzle cavity receiving fuel from the valve outlet;

the metering plate defining a plurality of circumferentially spaced exit cavities receiving fuel from the nozzle cavity, each exit cavity radially spaced from the longitudinal axis and oriented along a radial axis; and each exit cavity having an upstream portion and a downstream portion, the upstream portion defined by a series of at least three steps, the upstream portion of each exit cavity narrowing towards the downstream portion.

2. The nozzle of claim 1, wherein the series of steps define a series of recirculation zones.

3. The nozzle of claim 2, wherein each recirculation zone is located on an upper surface of each step.

4. The nozzle of claim 1, wherein the series of steps form a generally conical shape.

5. The nozzle of claim 1, wherein each step is annular in shape.

6. The nozzle of claim 5, wherein each step forms a square or rectangular ring-shape.

7. The nozzle of claim 1, wherein each exit cavity defines an exit axis, each exit axis being tilted in the radial direction relative to the longitudinal axis to increase the spray angle of the nozzle.

8. The nozzle of claim 1, wherein each exit cavity defines an exit axis, each exit axis being tilted in a plane perpendicular to the respective radial axis, each exit axis being non-parallel to the longitudinal axis to produce a swirl component to the fuel exiting the nozzle.

9. The nozzle of claim 1, wherein each step is formed by a first surface of the exit cavity being angled relative to a second surface of the exit cavity.

10. The nozzle of claim 1, wherein each step includes a radial surface extending radially and wherein each radial surface is located radially within the exit cavity.

11. The nozzle of claim 1, wherein the series of steps are concentrically arranged.

12. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate defining a nozzle cavity receiving fuel from the valve outlet;

the metering plate defining a plurality of circumferentially spaced exit cavities receiving fuel from the nozzle cavity, each exit cavity radially spaced from the longitudinal axis and oriented along a radial axis;

each exit cavity having an upstream portion and a downstream portion, the upstream portion defined by a series of steps, each step being formed by a first surface of the exit cavity being angled relative to a second surface of the exit cavity the upstream portion of each exit cavity narrowing towards the downstream portion; and the metering plate including an upper surface and a lower surface, and wherein neither the first surface nor the second surface are formed by the upper or lower surfaces.

13. The nozzle of claim 12, wherein the series of steps define a series of recirculation zones.

14. The nozzle of claim 13, wherein each recirculation zone is located on an upper surface of each step.

15. The nozzle of claim 12, wherein the series of steps form a generally conical shape.

16. The nozzle of claim 12, wherein each step is annular in shape.

17. The nozzle of claim 16, wherein each step forms a square or rectangular ring-shape.

18. The nozzle of claim 12, wherein each exit cavity defines an exit axis, each exit axis being tilted in the radial direction relative to the longitudinal axis to increase the spray angle of the nozzle.

19. The nozzle of claim 12, wherein each exit cavity defines an exit axis, each exit axis being tilted in a plane perpendicular to the respective radial axis, each exit axis being non-parallel to the longitudinal axis to produce a swirl component to the fuel exiting the nozzle.

20. The nozzle of claim 12, wherein each step includes a radial surface extending radially and wherein each radial surface is located radially within the exit cavity.

* * * * *